US007364240B2

(12) United States Patent
Seely

(10) Patent No.: US 7,364,240 B2
(45) Date of Patent: Apr. 29, 2008

(54) RESURFACING ICE SKATING RINKS

(75) Inventor: Scott Hastings Seely, Chesterfield County, VA (US)

(73) Assignee: Edward Wisz, Midlothian, VA (US)

( * ) Notice: Subject to any disclaimer, the term of this patent is extended or adjusted under 35 U.S.C. 154(b) by 405 days.

(21) Appl. No.: 11/078,018

(22) Filed: Mar. 12, 2005

(65) Prior Publication Data

US 2006/0097564 A1 May 11, 2006

Related U.S. Application Data

(60) Provisional application No. 60/552,820, filed on Mar. 12, 2004.

(51) Int. Cl.
*A63C 19/10* (2006.01)

(52) U.S. Cl. ..... 299/24; 37/219

(58) Field of Classification Search ..... 299/24; 37/195, 196, 197, 227, 219, 220, 221, 214, 37/218, 268; 401/137, 139
See application file for complete search history.

(56) References Cited

U.S. PATENT DOCUMENTS

| | | | | |
|---|---|---|---|---|
| 2,795,870 A | | 6/1957 | Leduc | |
| 3,044,193 A | * | 7/1962 | Zamboni | 37/219 |
| 3,178,837 A | | 4/1965 | Capalbo | |
| 3,302,975 A | | 2/1967 | Vandenberg | |
| 3,475,056 A | | 10/1969 | Jones | |
| 3,591,236 A | | 7/1971 | Jones | |
| 3,705,746 A | | 12/1972 | McLeod | |
| 3,917,350 A | | 11/1975 | Bricher | |
| 4,312,142 A | | 1/1982 | Toepffer | |
| 4,317,298 A | | 3/1982 | Mathers | |
| 4,372,617 A | | 2/1983 | Zamboni | |
| 4,705,320 A | * | 11/1987 | Zamboni | 299/24 |
| 4,728,536 A | | 3/1988 | Burley et al. | |
| 4,918,844 A | | 4/1990 | Marsh | |
| 5,701,690 A | | 12/1997 | Miscio | |
| 5,771,698 A | | 6/1998 | Abel | |
| 6,119,466 A | | 9/2000 | Vaillancourt | |

(Continued)

FOREIGN PATENT DOCUMENTS

WO WO 94/10392 A1 5/1994

(Continued)

OTHER PUBLICATIONS

Dirtworks (www.dirt-works.net), "The DirtWorks 3-Point Hitch System", internet article, Mar. 17, 2005, 3 pages.

(Continued)

*Primary Examiner*—Sunil Singh
(74) *Attorney, Agent, or Firm*—Thompson McMullan; Robert C. Lyne, Jr.

(57) ABSTRACT

An ice resurfacing machine for small and medium-size indoor and outdoor ice skating rinks comprises a light towing vehicle, a resurfacing attachment, and a lifting and leveling assembly connecting them. To eliminate ruts in the ice, the machine removes only a thin layer of ice by scraping, fills the ruts with "snow" created by the scraping, skating, and precipitation, and adds water to fill the rut. The cold from the base ice and/or the atmosphere freezes the water and thus eliminates the rut. The machine may also be used to remove heavy snow or reduce the thickness of the ice.

14 Claims, 6 Drawing Sheets

U.S. PATENT DOCUMENTS

| | | | |
|---|---|---|---|
| 6,138,387 | A | 10/2000 | Fox et al. |
| 6,477,794 | B1 | 11/2002 | Hoffmann |
| 2003/0070326 | A1 | 4/2003 | Beilin et al. |
| 2004/0187357 | A1 | 9/2004 | Pirila |

FOREIGN PATENT DOCUMENTS

| | | | |
|---|---|---|---|
| WO | WO 94/10393 | A1 | 5/1994 |
| WO | WO 02/093106 | A1 | 11/2002 |
| WO | WO 03/033992 | A2 | 4/2003 |
| WO | WO 2004/083528 | A1 | 9/2004 |

OTHER PUBLICATIONS

Howstuffworks (www.people.howstuffworks.com), How Ice Rinks Work, internet article, Mar. 17, 2005, 3 pages.

Olympia Ice Resurfacer (www.beckerarean.com), Tractor Mount Olympia 250, p.28, internet article, undated.

Virginia Golf Cars (www.vagolfcars.com), Welcome to Virginia Gold Cars, internet article, May 12, 2005 2 pages.

Zamboni Model 100 (ww.zamboni.com), internet article, Mar. 17, 2005 1 page.

* cited by examiner

RESURFACING ICE SKATING RINKS

CROSS REFERENCE TO RELATED APPLICATION

This application discloses and claims subject matter which was disclosed in provisional patent application Ser. No. 60/552,820, filed Mar. 12, 2004.

FIELD OF THE INVENTION

This invention relates to a system for resurfacing ice skating rinks.

BACKGROUND OF THE INVENTION

Ice skating is extremely popular in the northern states of America and is growing increasingly popular in the southern states. The demands for ice skating surfaces are becoming nearly impossible to meet. Many ice rinks have to operate 24 hours a day to meet skaters' needs. The number and availability of ice skating rinks are limited by the maintenance required to keep the quality of the ice surface in an optimum or at least satisfactory condition. Such maintenance involves eliminating ruts and the like created by the skaters, removing the resulting ice particles, removing any fallen snow accumulation (in the case of an outdoor rink), and controlling the thickness of the ice.

It is important to control the thickness of the ice. The average ice thickness on an indoor ice skating rink is about 0.75 to 1.0 inch. If, for example, a person were merely to constantly shovel away the ice powder created after an ice skating session and reapply water, the ice would eventually become too thick for the ice chillers to handle and the ice would become soft and wet.

Backyard or homemade ice rinks, ponds, and lakes are called natural ice skating surfaces. They are usually created outdoors when the temperature is constantly below 25° F. Natural ice skating surfaces rely on cold air temperatures to keep the surface frozen. Even in colder climates, ice skating surfaces cannot have thick ice because they are hard to keep frozen. Natural ice skating surfaces also have the disadvantage of not having protection from snowfall.

Typically these smaller rinks are maintained manually, by one or more persons using hand tools, such as a shovel, a wheelbarrow, a hose, and a T-shaped squeegee-like implement. This not only tends to be burdensome, labor intensive, energy-depleting, and slow, but it also may produce an uneven, unduly thick, and/or poor quality surface. As a practical matter, the long term result of these deficiencies is likely to be that the ice surface is resurfaced with insufficient frequency. Manual maintenance also requires fairly large quantities of water, and sometimes creates fog which can be a problem in enclosed rinks. As a member of a neighborhood recreation association having a 7,000 sq. ft. indoor ice skating rink, I have had personal experience in hand shoveling and resurfacing and the attending disadvantages thereof. That experience led to the present invention.

Large ice resurfacing machines such as those sold under the trademark Zamboni® or Olympia® have been used for many years for large rinks, for example regulation hockey rinks having regulation dimensions of 200 ft.×85 ft. and other rinks having an area of 19,000 to 20,000 sq. ft. These large machines are excellent for large rinks, but their initial expense, size, complexity, training, maintenance, and storage requirements render them less suitable for medium and small size rinks, such as those operated by homeowners, municipalities, recreation associations, parks, private establishments, and the like. Currently such machines of one manufacturer have a selling price in the lower $70,000 range and weigh in excess of 9,000 pounds. Also, their size limits their turning radius and maneuverability and often requires a separate building for storage. In addition, they are complex, requiring considerable skilled maintenance and operator training. Certification of an operator of one of these machines requires that he or she attend a 3-day training course. More recently, downsized versions of these machines such as the Zamboni® Model 100 and the Olympia 250® have become available, but aside from their size and weight these have many of the same shortcomings.

The Zamboni® and Olympia® and various other machines shave off a surface ice layer of a sufficient depth, which can be as much as ⅛ inch, to remove substantially all of the ruts, and then deposit water on the resulting rut-free substrate so as to create an entirely new layer of fresh ice on the substrate. The shaving produces a rather large quantity of ice particles or "snow", which is carried away by conveyors in the machine, stored in a snow box in the machine, and later disposed of as waste.

There has been a long-felt but unmet need for an ice resurfacing machine which has the following attributes and capabilities: relatively low initial cost; compact; easily maneuverable; short turning radius; easy to maintain and repair with standard parts; operator friendly; minimum water requirements; minimum snow disposal requirements; fast; adjustable; flexible, with ice thickness reduction capability and heavy snow removal capability; providing high quality ice surfaces; suitable for ice skating rinks of any size, including small and medium size rinks; and suitable for both indoor and outdoor use.

BRIEF SUMMARY OF THE INVENTION

An object of the invention is to fill the above-identified need, or at least provide as many of the attributes and capabilities as possible, bearing in mind the compromises necessary to reconcile the inherent competition between them.

Rather than remove a layer of ice that is sufficiently thick to remove substantially all of the ruts and then replace it with water, the present invention removes only a thin layer of ice, leaves the ruts, fills the ruts with snow, and adds hot water to fill the interstices in the snow in the ruts and melt that snow. This leaves the ruts completely filled with water, which when frozen will provide a smooth ice surface and effectively eliminate the ruts.

The inventive approach eliminates the need for apparatus to convey large quantities of snow off the ice and into the resurfacing machine, to store it in the machine, and to haul it away. This greatly reduces the cost, size, weight, and complexity of the machine. It also conserves water. Also, the inventive machine has the capabilities of removing heavy snow and reducing ice thickness. In addition, it is easy to operate and maintain and produces an excellent ice surface. Further, it works sufficiently fast to be useful for larger rinks as well as small and medium-size rinks.

Apparatus utilizing this approach takes advantage of and enhances these and other aspects and advantages of the invention, including an integrated combination of a light towing vehicle, a compact resurfacing attachment, and a lifting and leveling assembly connecting the vehicle and the attachment.

Sales data for ice resurfacing machines according to the present invention are consistent with my belief that the invention fills a long-felt need. My company, Ragged Point Industries, sells these machines under the trademark "The Ice Wizard". The first sale took place on Sep. 27, 2004. In the less than 6 months since then, we have sold 22 of these ice resurfacing machines, in the United States and abroad. One of these machines is being used at the ice skating rink on the Eiffel Tower in Paris. Four of them are being used at ice rinks in Saudi Arabia, and another one is being shipped to Saudi Arabia. Ours is not a large or sophisticated operation, as all of these machines were assembled by my partner and me at my personal residence, when we were (as we still are) employed full-time in our "day jobs".

DETAILED DESCRIPTION OF THE INVENTION

Definitions

The following terms are used throughout this application in accordance with these definitions, unless a different interpretation is required by the context.

The terms "ice rink" and "rink" refer to ice having a horizontal surface used for ice skating, including recreational, professional, hockey, or figure skating, whether located indoors or outdoors, constructed or naturally occurring (such as a pond), or cooled naturally or by refrigeration.

The term "rut" refers to local, concave imperfections in the surface of an ice rink, including grooves, nicks, cracks, and gouges. (Ruts are typically caused by ice skate blades, falls, and hockey sticks.)

The term "snow" refers to particles of frozen water removed from the surface of an ice rink by scraping, including scrapings of the top layer of the ice, skater-generated snow, fallen snow, sleet, frozen rain, condensation, or other precipitation on the surface, including any liquid water mixed with them. Since "snow" includes associated liquid water, its nature will vary greatly depending upon wetness, compaction, temperature, slushiness, particle size, flowability, stickiness, etc.

The term "average thickness", in a reference to a layer of snow being removed by a scraper blade from an ice surface, means the theoretical thickness the layer would have if the surface were perfectly and uniformly flat and level.

The term "box" is used in accordance with its dictionary definition relating to machines, e.g., an enclosing casing or part in a machine.

The term "cut", used as a noun, means a series of passes of the machine, usually overlapping, that cover a desired rink area, as one would use that term with respect to mowing a lawn or field.

The Ice Resurfacing Machine

Figure 1:
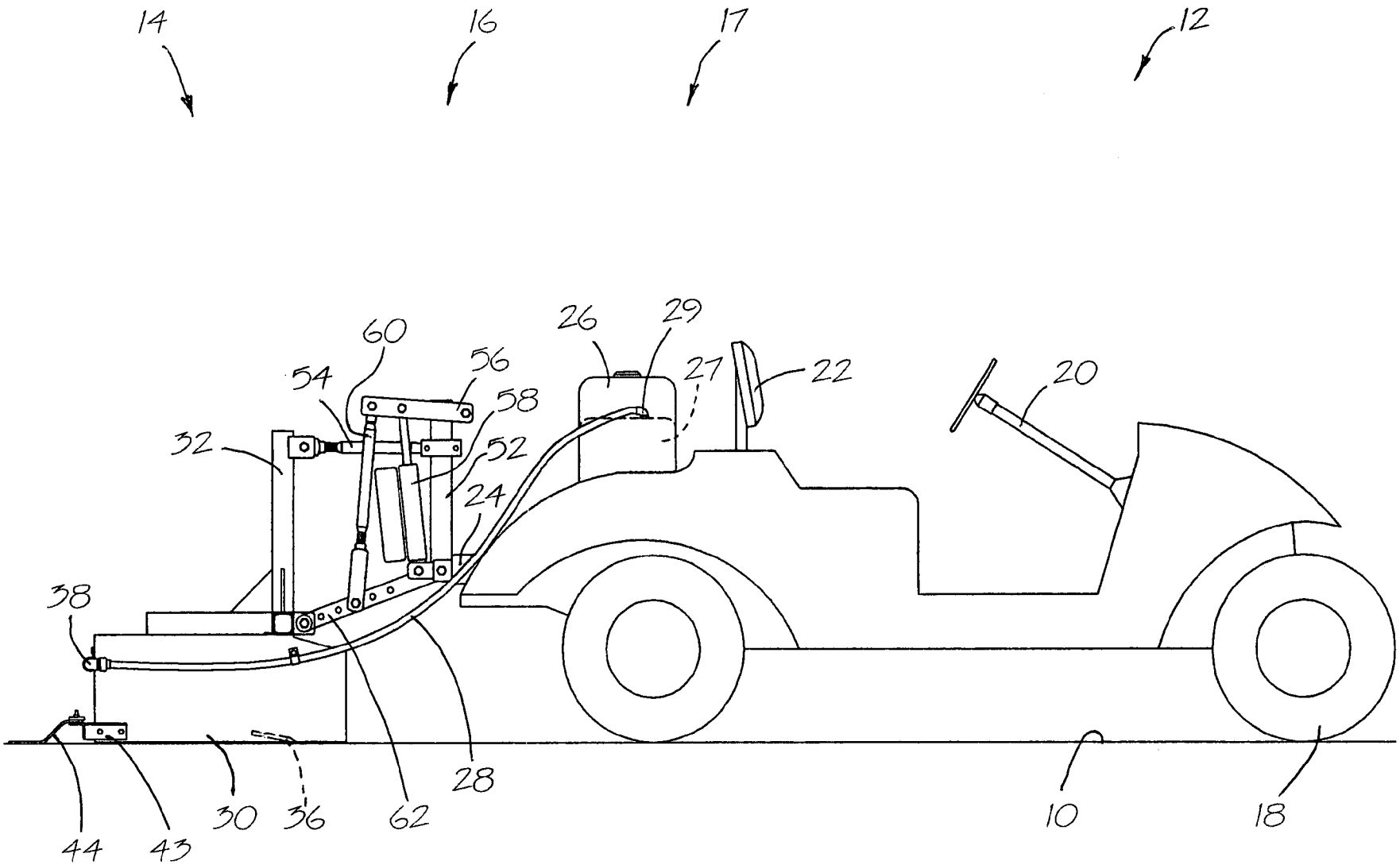
FIG. 1 is a right side elevation view of an ice resurfacing machine according to the invention, resting on an ice surface.

FIG. 1 shows an ice resurfacing machine according to the present invention resting on ice surface 10. The machine consists of four groups of components—vehicle 12, resurfacing attachment 14, lifting and leveling assembly 16 connecting them, and water supply system 17.

Vehicle 12 has wheels 18, steering mechanism 20, driver's seat 22, a motor (not shown), a battery (not shown), and a standard trailer hitch receiver 24. The particular vehicle shown is a golf cart with an electric motor. Other vehicles, such as all-terrain vehicles and tractors, may be used for outdoor rinks. As an alternative to battery power, motors powered by compressed gas such as butane or propane may be used for indoor rinks.

Water supply system 17 consists of water supply tank 26 in vehicle 12 behind driver's seat 22. Located within tank 26 is water pump 27, which is connected to water supply line 28 via water regulator 29, which may be manually regulated to vary the volume of water flow. Water regulator 29 is a ball valve. Alternatively, water supply system 17 may be mounted on resurfacing attachment 14.

Figure 2:
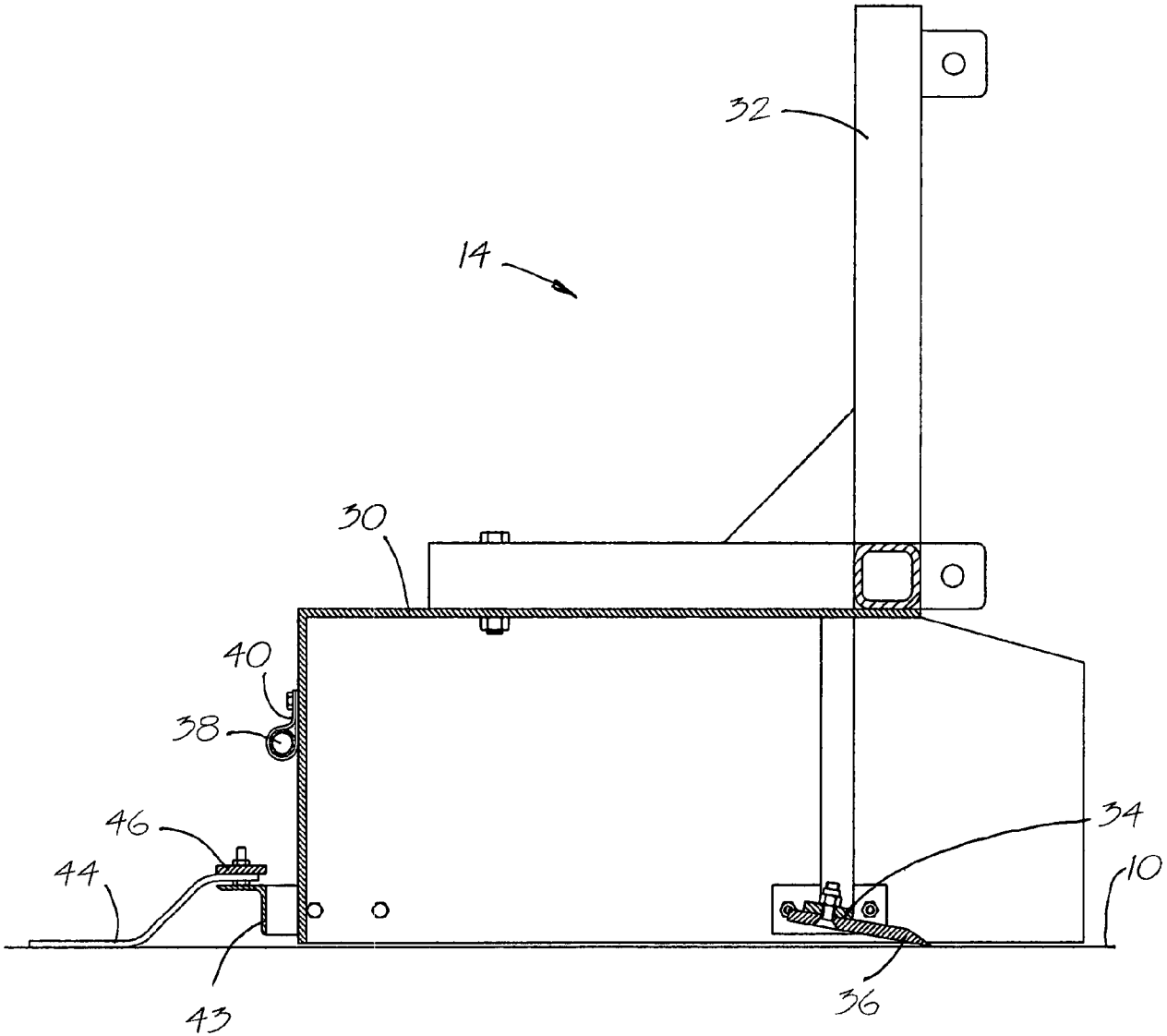
FIG. 2 is side section view of the resurfacing attachment shown in FIG. 1, showing a portion of the lifting and leveling assembly.
Figure 3:
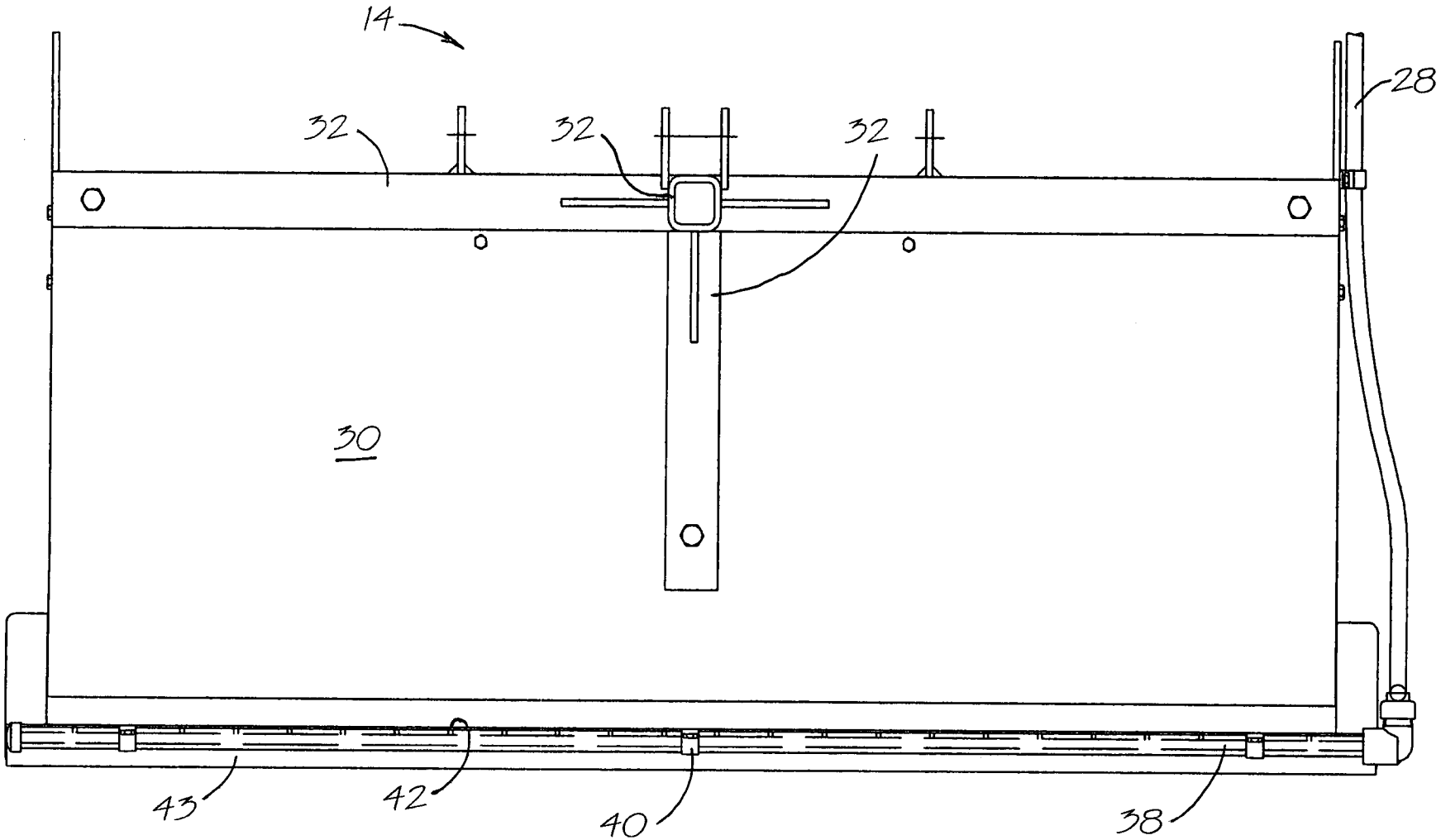
FIG. 3 is a plan view of the resurfacing attachment shown in FIGS. 1 and 2, with the water spreader towel removed.
Figure 4:
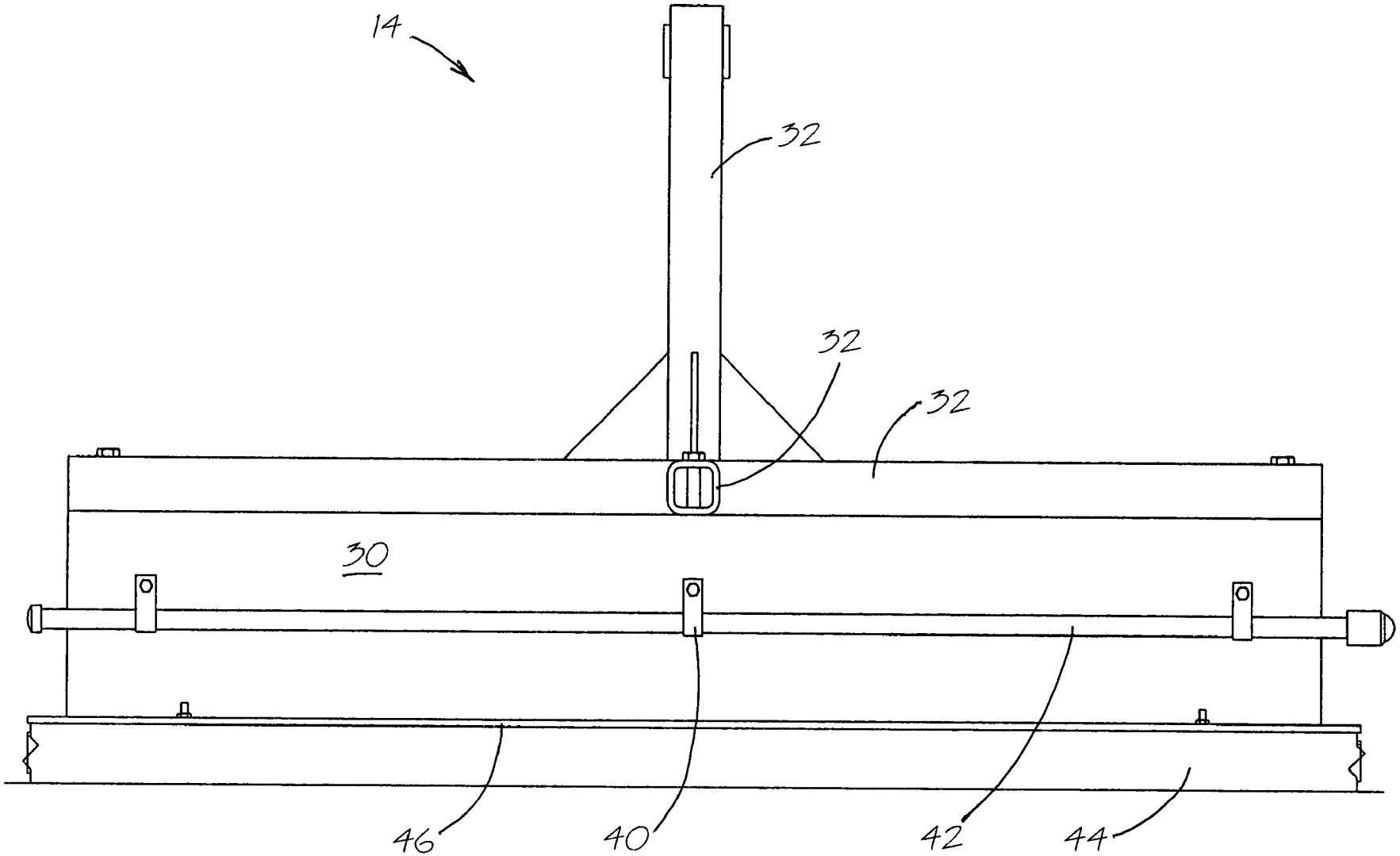
FIG. 4 is a rear view of the resurfacing attachment shown in FIGS. 1-3.

As shown in FIGS. 2, 3, and 4 as well as in FIG. 1, resurfacing attachment 14 includes snow box 30, which is open at the bottom and enclosed on the remaining five sides. It may be called either a "snow box", because of its function of generating, using, and collecting "snow", or an "ice box", because of its location and end product. It is made of sheet metal, but other materials such as plastic compositions may also be used. Attached to the top wall of snow box 30 is support frame 32, which consists of welded vertical, lateral, and longitudinal square metal tubes.

Ice blade mounting bar 34, which is shown in FIG. 2, extends laterally across the width of box 30 and is fastened to the side walls of box 30. Ice blade 36, which is made of tempered steel, is bolted to mounting bar 34 by two bolts in longitudinal slots in blade 36. The slots are parallel to the longitudinal axis of the vehicle. Mounting bar 34 and blade 36 are inclined at an angle of 12° to the surface of the ice. By loosening the bolts, sliding blade 36 in the slots forward or backward to a new position, and re-tightening the bolts, the height of the sharp cutting edge of the blade with respect to the bottom edges of the box may be varied. It is not possible, or necessary, to vary the height of the blade during resurfacing. Usually the edge of blade 36 will be coplanar with the bottom edges of box 30. For a dry cut to reduce ice thickness, the blade edge will extend below the box edges by ⅛ inch or so. The slots are sufficiently long to allow the blade edge to protrude ¼ inch below the box edges.

Water distributor 38 is a tube secured to the rear wall of snow box 30 by hangers 40. A number of aligned holes 42 spaced $V_2$ inch apart in the tube are aimed at the rear wall of box 30. One end of water distributor 38 is connected to water supply line 28 at a 90° elbow.

Also attached to the rear wall of snow box 30 is towel holder 43. Removably connected by studs to towel holder 43 are water spreader towel 44 and towel backing bar 46, which in turn are attached to each other. This connection enables the towel and backing bar to be quickly replaced so that the towel can be allowed to dry. Spreader towel 44 is made of terry cloth, while backing bar 46 is made of stainless steel. Towel 44 lies on the ice over the width of box 30. A spreader towel is sometimes referred to as a "mat".

Lifting and leveling assembly 16 includes at its front end a drawbar (not shown) which engages and is removably connected to hitch receiver 24. Post 52 is fixed to the drawbar. Pivotally connected to post 52 are central support arm 54 and two lever links 56, which in turn are pivotally connected at their rear ends to outer support arms 60 and farther forward to the piston of hydraulic unit 58 comprising a cylinder, piston, motor, pump, and fluid reservoir. Two support bars 62 are pivotally connected at their front ends to the drawbar, at their rear ends to snow box support frame 32, and in between to the lower ends of outer support arms 60. By virtue of their threaded parts, the three support arms 54, 60 are manually adjustable, and may be lengthened or shortened in turnbuckle fashion. The lifting and leveling assembly is a three point hitch, which was commercially available before the present invention was conceived.

Adjustment of support arm 54 levels the lower edges of snow box 30 from front to rear. Adjustment of support arms 60 levels the lower edges of the snow box 30 from side to side. Actuating hydraulic unit 58 to extend the piston lifts snow box 30 vertically, while actuating it to retract the piston lowers snow box 30 so that it rests on the surface of the ice.

Operation of the Ice Resurfacing Machine

The resurfacing machine may be used in three different modes—routine resurfacing mode, heavy snow removal mode, and ice thickness reduction mode. Routine resurfacing, the mode of its most frequent use, is appropriate after skaters have created snow and there has been no significant precipitation, extreme wear, or degradation. Heavy snow removal is appropriate when precipitation has fallen on an outdoor rink. Ice thickness reduction is appropriate when the thickness of the ice has become or is becoming thicker than 1 inch. It will be understood that other factors may be involved (for example, heavy snow resulting from especially vigorous skating, or falling and freezing condensation from the roof of an indoor rink) and that there is no bright line between the conditions warranting the selection of the appropriate mode. Usually, when either of the latter two modes is used, the operation will be immediately followed by a routine surfacing.

The heavy snow removal and ice thickness reduction modes are used without applying water to the surface of the ice and hence are sometimes referred to as a "dry cut". Towel 44 is removed for either of these modes. In the routine resurfacing mode, blade 36 is adjusted and secured so that it is coplanar with the bottom edges of box 30. In the heavy snow removal mode, blade 36 is either at that coplanar position or is adjusted and secured so that it is above the coplanar position. In the ice thickness reduction mode, blade 36 is adjusted and secured so that it is below the coplanar position.

The routine resurfacing mode is carried out as follows. The operator fills tank 26 with hot water having a temperature in the range of from about 95° F. to about 120° F. and, with the box in the raised position, drives vehicle 12 to the desired starting position on the ice. Then he or she lowers box 30 until it rests evenly on the surface of the ice, turns on pump 27, and drives around the ice in a desired pattern. Typically the pattern is a series of slightly overlapped ovals with ever-decreasing radii, possibly with an initial swath along the longitudinal axis of the rink to avoid ending with irregularities due to turning radius limitations. If the box fills completely with snow, the operator drives to a location either on the ice or on a smooth, level surface contiguous with the ice, stops the vehicle, and raises box 30, leaving the snow exposed on the surface, so that the "dumped" snow may be shoveled into a container such as cart, either then or later.

As so used in the routine resurfacing mode, the ice resurfacing machine depicted in the drawings will resurface about 8,000 sq. feet before box 30 fills up with snow to the extent that dumping is required. As used in either of the waterless modes, the box fills up more quickly and more frequent dumping is required. Also, the lower the position of blade 36, the more snow is collected and the more frequently dumping is required.

Whenever the machine is stopped on the ice, water pump 27 should be turned off and box 30 should be raised. Otherwise, the hot water will melt the ice and the towel or box will stick to the ice. This is accomplished manually by "Water On/Water Off" and "Snow Box Up/Snow Box Down" controls in vehicle 12.

In the routine resurfacing mode, with the edge of blade 36 coplanar with the bottom edge of box 30, blade 36 will lightly scrape the surface of the ice and remove the snow already on the surface of the ice and a very thin layer of the ice. I estimate that the average thickness of this layer is about 1/32 inch, and certainly less than 1/16 inch. Blade 36 also levels the ice by removing high spots and bumps.

If necessary to generate sufficient snow to fill the ruts in the surface of the ice, blade 36 may be lowered slightly. The blade may be effectively lowered in a small increment by stopping vehicle 12 and adjusting central support arm 60 so as to lower the front of box 30, which avoids the need to move blade 36 with respect to blade mounting bar 34 as described above.

During routine resurfacing, the operator manually controls water regulator 29 to adjust water flow as desired. Increased flow is warranted by higher vehicle speed, resurfaced areas that appear to have insufficient water, creating new ice at the beginning of the skating season, and building up low spots. Decreased flow is warranted by reduced vehicle speed (as may be necessary for turning corners) and standing water. The slower the vehicle speed, the better the quality of the ice resurfaced.

The ice resurfacing machine according to the invention requires very little maintenance. The operator needs to make sure the batteries have the proper charge and water levels. Most golf carts require a monthly water fill. The scraper blade, though it holds a good edge and is very durable, requires sharpening from time to time. Also, the individual components are relatively light and can be easily moved and handled by one or two people.

The Ice Resurfacing Method

Figure 5:
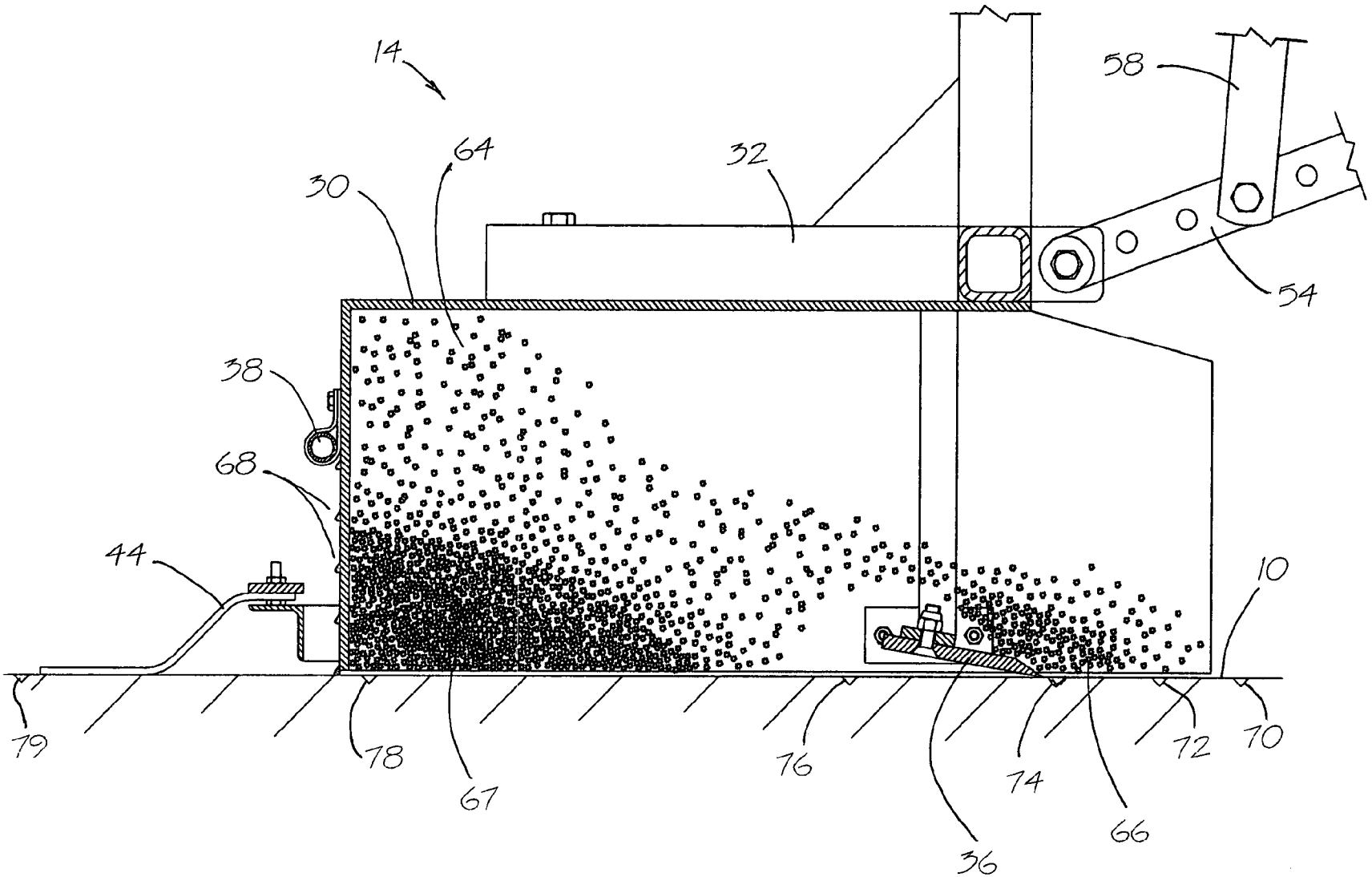
FIG. 5 is a view similar to FIG. 2, but showing the invention being used in resurfacing ice.

FIG. 5 shows resurfacing attachment 14 being used to resurface ice in the routine resurfacing mode, as it is being towed toward the right. Blade 36 is scraping ice surface 10 so as to create snow 64, most of which passes over blade 36 and proceeds to the rear of box 30. The snow is collected at 66 in the buildup just ahead of blade 36 and at 67 at the rear of box 30.

Meanwhile, water pump 27 pumps pressurized hot water from tank 26, through line 28, and into water distributor 38.

Pressurized water issuing from holes 42 in distributor 38 strikes the rear wall of box 30 and flows down its surface due to gravity and surface tension, as shown symbolically at 68, thereby further distributing the water in the transverse direction as it falls onto ice surface 10. Finally, towel 44 spreads the water uniformly across the surface of the ice, where it will freeze to form good ice, typically within a few minutes.

Figure 6:
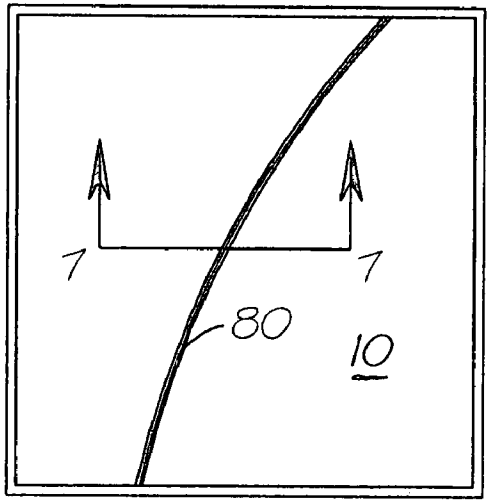
FIG. 6 is a plan view of a turn groove in an ice surface.
Figure 8:
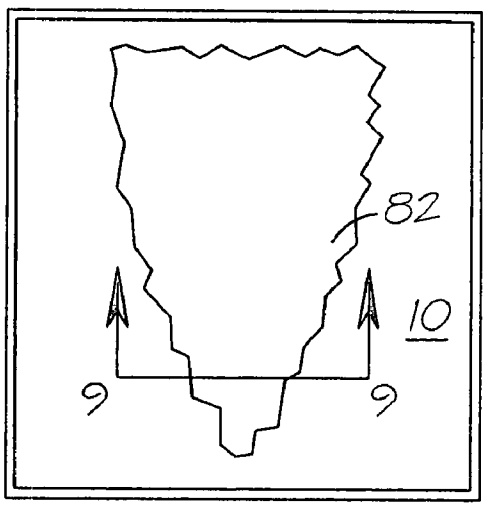
FIG. 8 is a plan view of a slip or stop gouge in an ice surface.
Figure 10:
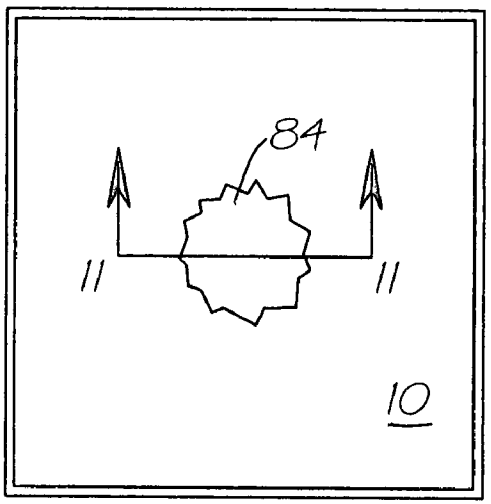
FIG. 10 is a plan view of a toe pick hole in an ice surface.
Figure 7:
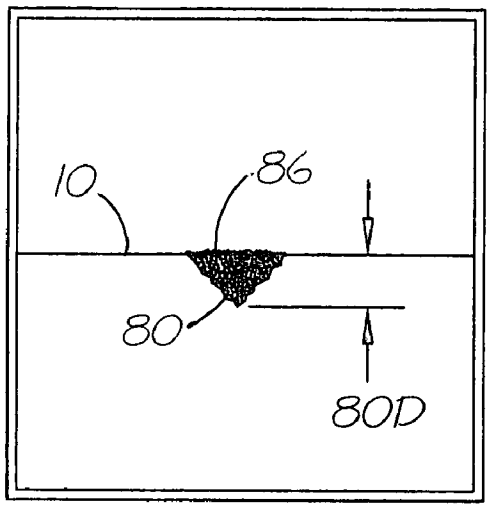
FIG. 7 is a section taken at 7-7 in FIG. 6, with the groove filled with snow.
Figure 9:
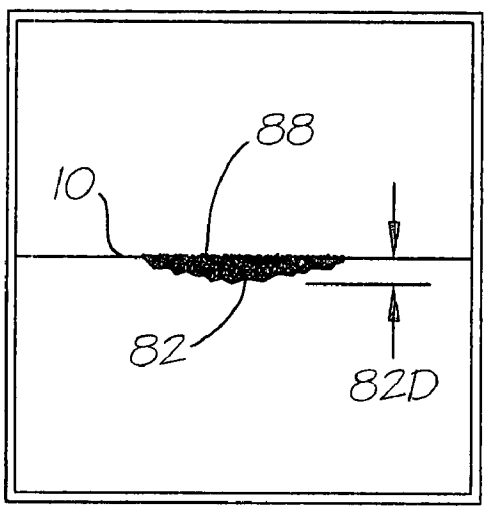
FIG. 9 is a section taken at 9-9 in FIG. 8, with the gouge filled with snow.
Figure 11:
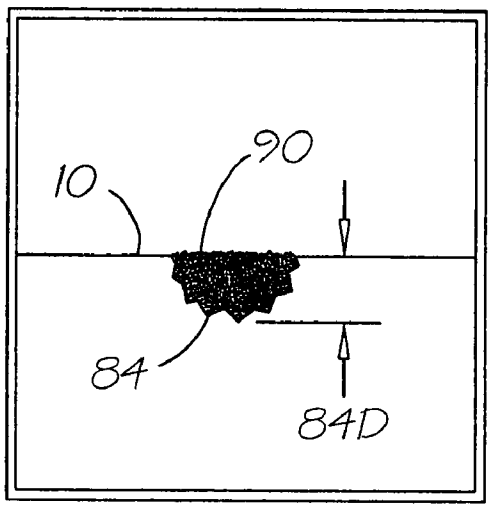
FIG. 11 is a section taken at 11-11 in FIG. 10, with the hole filled with snow.

FIGS. 6 through 11 show three types of ruts commonly made in the ice by skaters. FIGS. 6 and 7 show turn groove 80, which has a maximum depth of 80D. FIGS. 8 and 9 show slip or stop gouge 82, which has a maximum depth of 82D. FIGS. 10 and 11 show toe pick hole 84, which has a maximum depth of 84D. FIGS. 7, 9, and 11 show these ruts filled with snow, as will be explained next. Normally depths 80D and 84D are greater than 1/16 inch, but they sometimes go as deep as 1 inch (i.e., all the way through the ice). Normally depth 82D is less than 1/16 inch. Thus, the suffix "D" refers to the maximum depth of each of these ruts.

FIG. 5 depicts six ruts in the surface exaggeratedly at 70, 72, 74, 76, 78, 79, going from right to left. These ruts are in different locations with respect to box 30, blade 36, and towel 44, but will be used here to illustrate the sequence of the inventive resurfacing method for a single rut. Rut 70 is empty, and rut 72 is empty or nearly so. Rut 74 is partly or complete filled by collected snow from 66. Rut 76 differs from rut 74 in that its depth has been slightly reduced because a thin layer has been scraped off the surface of the ice by blade 36. Rut 78 has been filled, or topped off, by collected snow from 67. Such snow is shown in FIGS. 7, 9, and 11 at 86, 88, 90. Finally, rut 79 is filled with water, since the hot water filled the interstices of and melted the snow that had filled the rut.

Specific Data

Specific data for the resurfacing machine shown in the drawings are as follows:

| | |
|---|---|
| Dimensions | 121 in. long × 48 in. wide × 54 in. high |
| Weight | 950 pounds |
| Top speed | 12 mph |
| Capacity of water tank 26 | 25 gallons |
| Capacity of water pump 27 | 750 gallons per hour |
| Exterior dimensions of snow box 30 | 48 in. wide × 24 in. long × 10 in. high |
| Approximate time for routine resurfacing of 7,000 sq. ft. ice skating rink | 10 minutes or less |

Reference Character Table

The following table lists the reference characters and names of features and elements used herein, with asterisks indicating groups of features and elements:

| Ref. Char. | Feature or element | Paragraph introduced in | FIGS. shown in |
|---|---|---|---|
| 10 | ice surface | 0027 | 1, 2, 5, 6-11 |
| 12 | vehicle* | 0027, 0028 | 1 |
| 14 | resurfacing attachment* | 0027, 0030 | 1, 2-5 |
| 16 | lifting and leveling assembly* | 0027, 0034 | 1 |

-continued

| Ref. Char. | Feature or element | Paragraph introduced in | FIGS. shown in |
|---|---|---|---|
| 17 | water supply system* | 0027, 0029 | 1 |
| 18 | wheels | 0028 | 1 |
| 20 | steering mechanism | 0028 | 1 |
| 22 | driver's seat | 0028 | 1 |
| — | battery (not shown) | 0028 | — |
| — | motor (not shown) | 0028 | — |
| 24 | standard hitch receiver | 0028 | 1 |
| 26 | water supply tank | 0029 | 11 |
| 27 | water pump | 0029 | 1 |
| 28 | water supply line | 0029 | 1-3 |
| 29 | water regulator | 0029 | 1 |
| 30 | snow box or ice box | 0030 | 1-5 |
| 32 | snow box support frame | 0030 | 1-5 |
| 34 | blade mounting bar | 0031 | 2 |
| 36 | ice blade | 0031 | 1, 2, 5 |
| 38 | water distributor | 0032 | 1-5 |
| 40 | hangers | 0032 | 2-4 |
| 42 | holes | 0032 | 3 |
| 43 | towel holder | 0033 | 1, 2, 3 |
| 44 | water spreader towel | 0033 | 1, 2, 4, 5 |
| 46 | towel backing bar | 0033 | 2 |
| — | drawbar (not shown) | 0034 | — |
| 52 | post | 0034 | 1 |
| 54 | central support arm (adjustable) | 0034 | 1 |
| 56 | lever links | 0034 | 1 |
| 58 | hydraulic unit | 0034 | 1 |
| 60 | outer support arms (adjustable) | 0034 | 1 |
| 62 | support bars | 0034 | 1 |
| 64 | snow | 0045 | 5 |
| 66 | collected snow toward front of box | 0045 | 5 |
| 67 | collected snow toward rear of box | 0045 | 5 |
| 68 | water | 0048 | 5 |
| 70 | rut ahead of box front wall | 0048 | 5 |
| 72 | rut just behind box front wall | 0048 | 5 |
| 74 | rut beneath collected snow at 66 | 0048 | 5 |
| 76 | rut behind blade | 0048 | 5 |
| 78 | rut beneath collected snow at 67 | 0048 | 5 |
| 79 | rut behind towel | 0048 | 5 |
| 80 | turn groove | 0047 | 6, 7 |
| 80D | maximum depth of turn groove | 0047 | 7 |
| 82 | slip or stop gouge | 0047 | 8, 9 |
| 82D | maximum depth of slip or stop gouge | 0047 | 9 |
| 84 | toe pick hole | 0047 | 10, 11 |
| 84D | maximum depth of toe pick hole | 0047 | 11 |
| 86 | snow filling turn groove | 0047 | 7 |
| 88 | snow filling slip or stop gouge | 0047 | 9 |
| 90 | snow filling toe pick hole | 0047 | 11 |

It will be understood that, while presently preferred embodiments of the invention have been illustrated and described, the invention is not limited thereto, but may be otherwise variously embodied within the scope of the following claims. It will also be understood that the method claims are not intended to be limited to the particular sequence in which the method steps are listed therein, unless specifically stated therein or required by description set forth in the steps.

What is claimed is:

1. A method of resurfacing ice of the surface of an ice skating rink, which surface has a rut with a maximum depth of D, said method comprising:

(a) providing an ice resurfacing machine including
  (i) a vehicle having a motor, wheels driven by the motor, and a steering mechanism for steering the wheels;
  (ii) a resurfacing attachment including
    (1) a snow box;
    (2) a scraping blade secured within the snow box;
    (3) a water distributor;
    (4) a water spreader towel; and
  (iii) a water supply system including a water supply tank and a water line connecting the water tank and the water distributor;
(b) driving the machine across the surface of the ice, with the blade on the surface and the bottom of the snow box adjacent the surface;
(c) scraping the ice surface near the rut with the blade to remove a thin top layer of ice having an average thickness substantially less than D, to remove any projections of ice, thereby producing snow;
(d) collecting the snow in the snow box on the surface of the ice;
(e) carrying the snow in the snow box so that the collected snow slides along the surface of the ice;
(f) depositing some of the collected snow into the rut;
(g) continuing to carry the remainder of the collected snow in the snow box so that the snow slides along the surface of the ice;
(h) applying, via the water distributor, water to the rut and to the ice surface surrounding the rut;
(i) wiping the ice surface with the towel, thereby spreading the water over the ice surface and into any space remaining in the rut;
(j) allowing the water in the rut to melt the ice in the rut, so that the rut is filled with water; and
(k) allowing the water in the rut to solidify, so as to fill the rut with solid ice, thereby eliminating the rut and providing the resurfaced ice with a smooth surface.

2. A method according to claim 1 wherein the blade extends across the width of the snow box, the water applied to the surface of the ice is at a temperature in the range of about 95 degrees F to about 120 degrees F, and the water distributor and the water spreader towel are mounted at the rear of the snow box.

3. A method according to claim 1 wherein a number of ruts are simultaneously also filled with ice.

4. A method according to claim 1 wherein at least some of the snow passes over the blade and is collected in the snow box behind the blade.

5. A method according to claim 1 wherein the average thickness of the thin top layer of ice removed is less than 1/16 inch.

6. A method according to claim 1 further comprising stopping the machine at a desired location on the ice, lifting the snow box vertically off the ice to expose the collected snow, and removing the collected snow.

7. A method according to claim 1 wherein the driving is continued in an overlapping, oval fashion until substantially the entire rink is resurfaced.

8. A method according to claim 1 wherein the front of the blade and the lower edges of the snow box are secured in a substantially coplanar relationship during the entire resurfacing.

9. A method according to claim 1 comprising further providing a hitch receiver mounted on the vehicle and a lifting and leveling assembly connecting the resurfacing attachment to the hitch receiver.

10. A method according to claim 9 wherein the lifting and leveling assembly is a three-point hitch with three arms whose lengths are adjustable.

11. A method according to claim 1 comprising preliminary passes of the machine over the surface of the ice to be resurfaced in order to remove excessive snow therefrom prior to resurfacing, which preliminary passes are performed without applying water.

12. A method according to claim 11 wherein during the preliminary passes the blade is either removed or adjusted so that it does not contact the ice.

13. A method according to claim 1 comprising preliminary passes of the machine over the surface of the ice to be resurfaced in order to reduce the thickness of the ice prior to resurfacing, which pass is performed without applying water.

14. A method according to claim 13 wherein during the preliminary pass the front of the blade and the lower edges of the snow box are secured in a relationship such that the blade extends below the edges.

* * * * *